US009119760B2

(12) United States Patent
Purdy et al.

(10) Patent No.: US 9,119,760 B2
(45) Date of Patent: Sep. 1, 2015

(54) COMPRESSION DEVICE IN COMBINATION WITH LOWER LIMB PROTECTION

(76) Inventors: William Purdy, White Plains, NY (US); Robert Purdy, Bedford, NY (US)

( * ) Notice: Subject to any disclaimer, the term of this patent is extended or adjusted under 35 U.S.C. 154(b) by 573 days.

(21) Appl. No.: 13/493,601

(22) Filed: Jun. 11, 2012

(65) Prior Publication Data

US 2012/0316481 A1 Dec. 13, 2012

Related U.S. Application Data

(60) Provisional application No. 61/614,794, filed on Mar. 23, 2012, provisional application No. 61/495,100, filed on Jun. 9, 2011.

(51) Int. Cl.

| | |
|---|---|
| ***A61H 7/00*** | (2006.01) |
| ***A61H 19/00*** | (2006.01) |
| ***A61H 9/00*** | (2006.01) |

(52) U.S. Cl.

CPC ..... *A61H 9/0078* (2013.01); *A61H 2201/0257* (2013.01); *A61H 2201/0278* (2013.01); *A61H 2201/165* (2013.01); *A61H 2201/1642* (2013.01); *A61H 2201/1654* (2013.01); *A61H 2203/0468* (2013.01); *A61H 2205/106* (2013.01); *A61H 2205/12* (2013.01); *A61H 2209/00* (2013.01)

(58) Field of Classification Search

CPC ..... A61H 9/00; A61H 9/0007; A61H 9/005; A61H 9/0078; A61H 9/0092

USPC ..... 601/23, 33–35, 148–152; 602/13

See application file for complete search history.

(56) References Cited

U.S. PATENT DOCUMENTS

| | | | | |
|---|---|---|---|---|
| 5,868,690 | A * | 2/1999 | Eischen, Sr. | 601/151 |
| 5,891,065 | A * | 4/1999 | Cariapa et al. | 601/152 |
| 6,846,295 | B1 * | 1/2005 | Ben-Nun | 601/152 |
| 8,052,630 | B2 * | 11/2011 | Kloecker et al. | 602/75 |
| 2007/0083995 | A1 * | 4/2007 | Purdy et al. | 5/702 |
| 2007/0161933 | A1 * | 7/2007 | Ravikumar | 602/13 |
| 2010/0100018 | A1 * | 4/2010 | Fout | 602/13 |
| 2011/0306908 | A1 * | 12/2011 | Brown et al. | 601/151 |
| 2012/0253250 | A1 | 10/2012 | Spahn et al. | |

* cited by examiner

*Primary Examiner* — Justine Yu
*Assistant Examiner* — Kathrynn Reilly
(74) *Attorney, Agent, or Firm* — Porzio, Bromberg & Newman, P.C.

(57) ABSTRACT

The present invention relates to a support for a body part including a compression device in combination with a lower leg protection system. The compression device can be integral with the outer support at a position received over the lower leg. One or more valves can extend from a compression bladder for attachment to a pneumatic device. Inflation of the compression bladder positioner adjacent the lower leg also displaces air in the outer support toward the foot which causes simultaneous massaging of the foot. The pneumatic device can be adjusted to provide either sequential or intermittent therapies.

24 Claims, 17 Drawing Sheets

COMPRESSION DEVICE IN COMBINATION WITH LOWER LIMB PROTECTION

CROSS REFERENCE TO RELATED APPLICATION

This application claims the benefit of U.S. Provisional Patent Application No. 61/614,794 filed Mar. 23, 2012 and U.S. Provisional Patent Application No. 61/495,100 on Jun. 9, 2011, the entireties of which applications are hereby incorporated by reference into this application.

BACKGROUND OF THE INVENTION

Conventional supports provide a polyester filled or foam boot for support of a lower leg. Other conventional supports include an ankle foot orthotic (AFO) or foot wrap. Another conventional support includes an air chamber in a boot configuration. The air chamber supports a leg and heel above a surface of a bed patient when lying in a supine and side lying position, such as in a hospital bed.

The conventional supports have the disadvantage that pressure is applied to the heel or leg for maintaining the heel above the surface of the bed. In addition, the leg can be raised too high such that joints can lock, nerves can be potentially entrapped and the circulation to the leg can be compromised. In addition, the intraluminal pressure of conventional supports minimizes its ability to contour to the object applying the force.

Sequential or intermittent compression devices have been described which include inflatable sleeves. The sleeve is placed over the leg or foot. Pressure modulation is used in order to reduce risk of clot formation in the leg or foot.

It is desirable to provide a sequential or intermittent compression device in combination with a lower leg protection system for supporting the leg and heel when a patient is recumbent while maintaining neutral leg alignment without lifting the leg and heel from the resting surface.

SUMMARY OF THE INVENTION

The present invention relates to a support for a body part including a compression device in combination with a lower leg protection system. The compression device can be inflated sequentially or intermittently. The compression device can be inlaid into a support boot and attached to the boot with a flexible material. A valve is combined with the compression device for increasing and reducing pressure within the compression device in a sequential or intermittent manner. It is optimal to barely elevate the heel from the surface of the bed. This helps to minimize leg rotation and locking of the knee.

In one embodiment, the compression device is combined with a fluidized lower protection system including an inner positioner and an outer support. The inner positioner includes a bladder, preferably filled with a fluidized particulate material, to provide three-dimensional contouring to the lower leg and heel. The inner positioner has low pressure and is not sufficient alone to support the leg. The inner positioner has little or no flow characteristics unless an outside force is applied other than gravity. The inner positioner can displace and contour three-dimensionally as though it was fluid to the sides and top of the leg while not having flow characteristics that would result in migration of the medium under the force of gravity. The inner positioner can provide three-dimensional contouring to the Achilles tendon. The inner positioner can include a temperature regulating material for keeping the leg in an optimal range of skin temperature to keep the leg comfortable longer. The inner positioner can be shaped as a pad to mold to the underside portion of the lower leg and heel. Alternatively, the inner positioner can include various shapes to support the lower leg and heel. In one embodiment, the inner positioner also includes a portion which extends over a top portion of the leg, such as the shin.

The outer support is received over the inner positioner. The outer support can be in the shape of an open boot. In one embodiment, the compression device can be integral with the outer support at a position received over the lower leg. One or more valves can extend from a compression bladder for attachment to a pneumatic device. Inflation of the compression bladder positioner adjacent the lower leg also displaces air in the outer support toward the foot which causes simultaneous massaging of the foot. The pneumatic device can be adjusted to provide either sequential or intermittent therapies.

The outer support can include an ultra low pressure plenum. The ultra low pressure plenum is filled at a predetermined low pressure for distributing pressure along the length of the outer support, but not providing significant elevation of the lower leg and heel by itself. In this embodiment, the inner positioner is partially filled with the fluidized particulate material so it cannot support a leg on its own. For example, the inner positioner can be filled up to ⅔ of its capacity. The outer portion of the inner positioner contours to the inner portion of the ultra low pressure plenum for providing more air displacement of the outer support than if the inner positioner was not present.

In one embodiment the system is strapless. In an alternate embodiment, the system includes a strap for attachment of the outer support to the leg. The strap can be sufficiently wide and cushioned to protect the skin. In one embodiment, the strap is air bearing. In one embodiment, a rear end of the outer support includes a gate, which can be opened to allow access to the foot and heel from the rear of the boot.

The inner positioner or outer support can include a fluidized thermal regulating medium. In one embodiment, a phase change material can be used for adjusting the temperature of the system.

The system of the present invention can be a one size fits all and adapts to the size and shape of a patient's leg. The system maintains neutral alignment and helps prevent foot drop. The system gently but securely wraps the leg, helping to maintain constant heel position. The system promotes proper dorsiflexion without causing undue pressure on the lower limb.

The combination of the inner positioner including a fluidized medium along with the outer support including a ultra low pressure plenum creates sufficient support of the lower leg while responding to normal patient movement. The combination of the inner positioner and the outer support provides three-dimensional contouring to the lower leg and heel for micro adjustment while the outer support or boot is closed for minimizing friction and shear. This is not possible in conventional devices where the inner chamber is not free to communicate with the leg without negatively affecting the functionality of the outer chamber. In general, the custom fitting protection can be used in such a way as to elevate the foot without "locking out the knee" due to three-dimensional molding and provide comfort to the skin. The natural contour of the leg can be maintained while eliminating harmful pressure to the heel, ankle, Achilles and foot. The system of the present invention can respond to the twisting of the leg without causing movement of the outer support. The system of the present invention can minimize shear forces that would be associated with a non-fluidized medium.

The invention will be more fully described by reference to the following drawings.

DETAILED DESCRIPTION

Figure 1B:
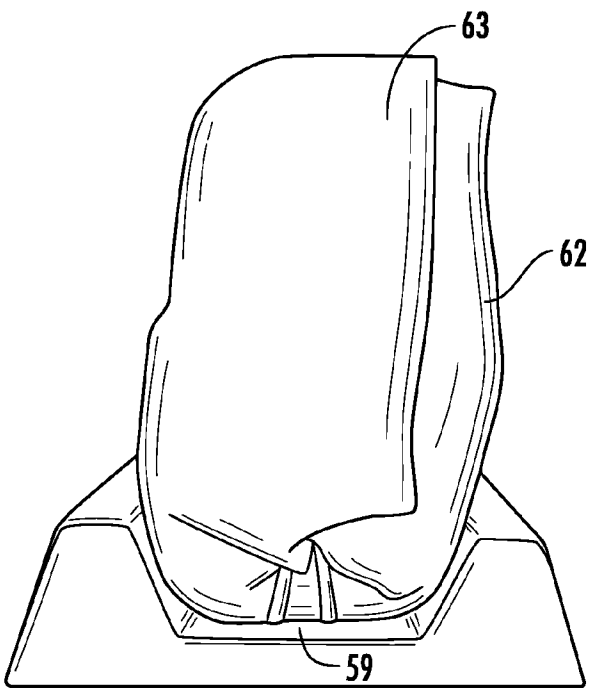
FIG. 1B is a rear schematic diagram of the compression device in combination with a fluidized lower leg protection and support system including an outer support, as shown in FIG. 1A.
Figure 1A:
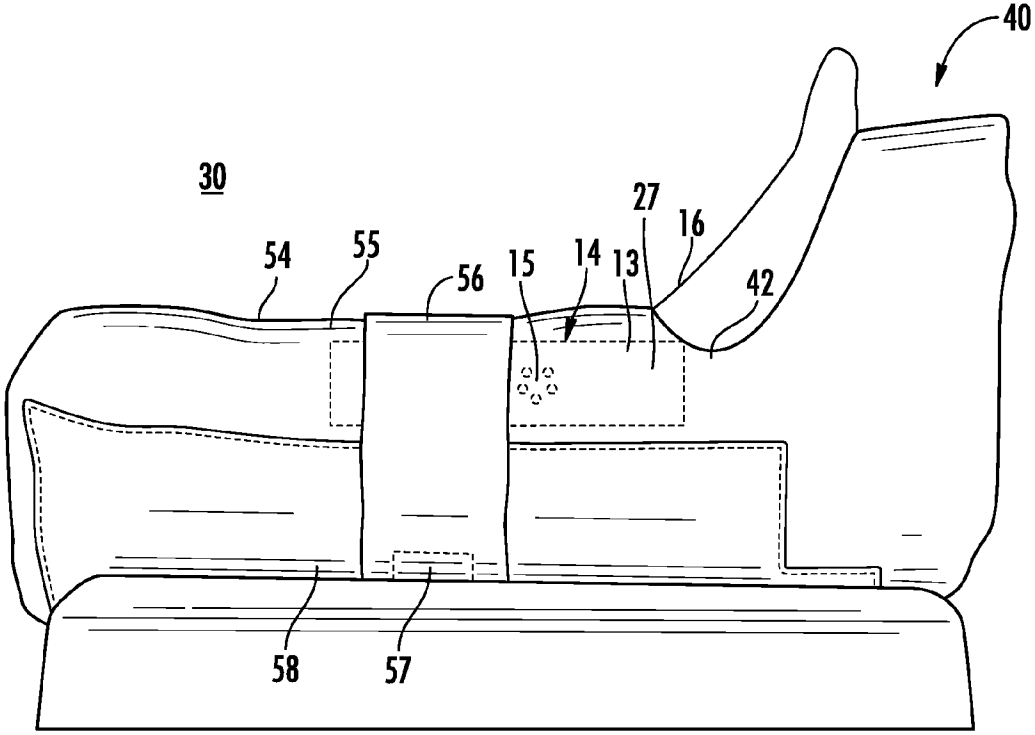
FIG. 1A is a side schematic diagram of an embodiment of a compression device in combination with a fluidized lower leg protection and support system including an outer support.
Figure 2:
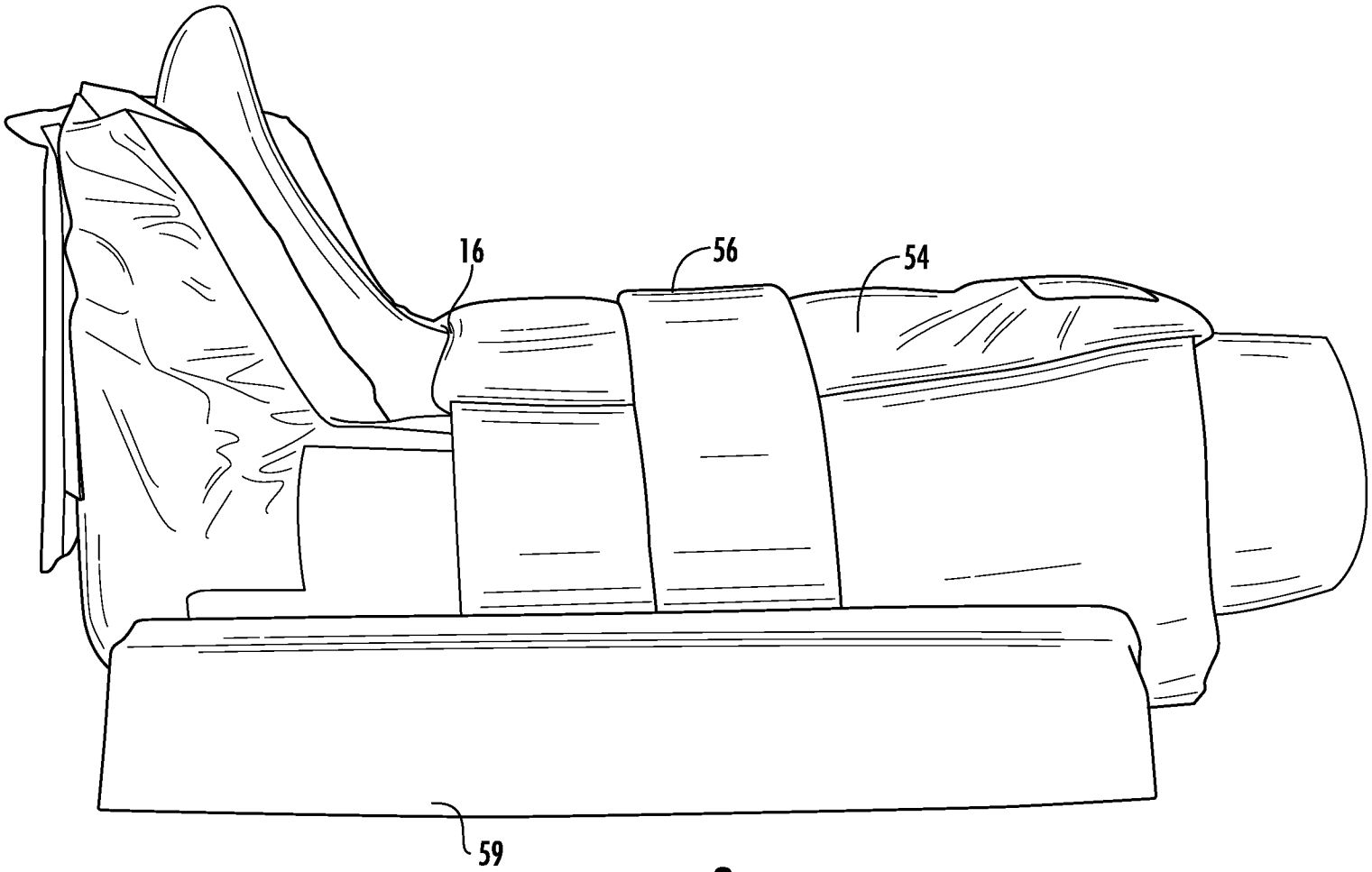
FIG. 2 is a schematic diagram of the embodiment of the compression device in combination with a fluidized lower leg protection and support system shown in FIG. 1A from an opposite side.

Reference will now be made in greater detail to a preferred embodiment of the invention, an example of which is illustrated in the accompanying drawings. Wherever possible, the same reference numerals will be used throughout the drawings and the description to refer to the same or like parts.

FIGS. 1-5 illustrate an embodiment of a compression device in combination with a lower leg protection and support system 30.

Compression system 40 is combined with fluidized lower leg support system 50. In one embodiment, compression system 40 can be inlaid into lower leg protection and support system 50 and attached thereto with coupling member 42. Lower leg protection and support system 50 can be a conventional support boot. In one embodiment, lower leg protection and support system 50 includes outer support 52 and inner positioner 14. Compression system 40 can include bladder 44 attached with coupling member 42 to outer support 52. Valve 46 can be associated with compression system 40 for inflating and deflating compression system 40 in a sequential or intermittent manner.

Figure 3:
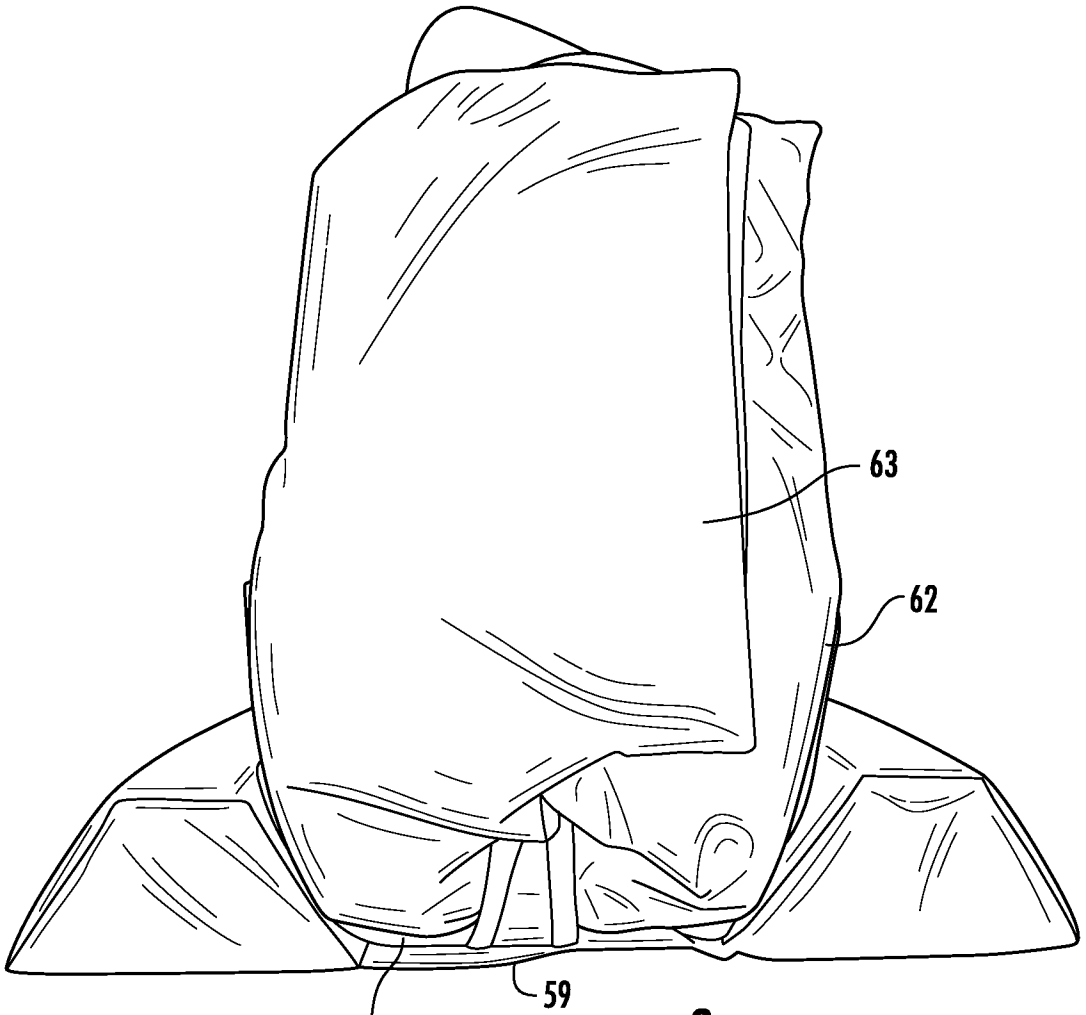
FIG. 3 is a schematic diagram of the embodiment of the compression device in combination with a fluidized lower leg protection and support system shown in FIG. 1A from a rear side.

Outer support 52 can include a plurality of rows of parallel ultra low pressure plenums 53. For example, ultra low pressure plenums 53 can be positioned within outer support 52 along the length $L_1$ of outer support 52. Flap 54 can extend over front of lower leg 16. Flap 54 can include ultra low pressure air plenums 55, which protect lower leg 16 from strap 56. Flap 54 can also provide anti-rotation of fluidized lower leg protection and support system 50. Strap 56 can be adjustable for closing flap 54 for different sizes of legs. Strap 54 can include a coupling portion 57 at one end thereof for attaching to attachment section 58. Strap 56 can include a cushioning material. In one embodiment, strap 56 is air bearing. Coupling portion 57 can be formed of a hook and loop material. Attachment section 58 can be formed of a hook and loop material. Attachment section 58 can be positioned along length $L_1$ of outer support 52. Outer support 52 can be received under U-shaped base 59, as shown in FIG. 3. U-shaped base 59 provides anti-rotation of outer support 52. Air pressure within ultra low pressure plenum 53 is reduced sufficiently to provide reduced pressure for conforming outer support 52 to the shape of lower leg 16 and optionally heel 17 for distributing pressure along the length of outer support 52, but is not providing support of lower leg 16 and heel 17.

Inner positioner 14 is formed of bladder 13 including fluidized material 15 therein which can retain its shape after sculpting. Fluidized material 15 can be a particulate material including interstitial spaces between the particles. A lubricant can be present in the interstitial spaces. For example, the lubricant can be a particulate material having a lower coefficient of friction, such as a powder. The volume of the particulate material can be controlled for controlling the interstitial air within the fluidized medium.

Bladder 13 is filled with fluidized material 15 which can retain its shape after sculpting. The flowability or lubricity of fluidized material 15 can be increased by adding a lubricant or by the removal of air from the interstitial spaces or both. The preferred medium of fluidized material 15 is a particulate material that has been modified in such a way that it acts like a fluid Fluidized material 15 refers to a compound or composition which can be sculpted and retain its shape and has no memory or substantially no memory. The no memory or substantially no memory feature enables bladder 13 to increase in height and maintain support of a body part. Fluidized material 15 is made of a viscosity that will allow it to contour but not collapse under the weight of the body part.

At sea level, the normal interstitial air pressure would exceed about 760 millibars of mercury. This increases or decreases marginally as altitude varies. Depending on the nature of the particulate fluidized material 15, the pressure can be lowered below about 500 millibars, preferably, about 350 millibars to about 5 millibars, while still maintaining the necessary flow characteristics of the product. The amount the pressure is lowered is dependent on the interstitial spaces needed to provide desired flow characteristics of the product.

Fluidized material 15 can include beads, such as polyethylene or polystyrene (PS) beads, expanded polyethylene (PE), crosslinked expanded polyethylene (PE), polypropylene (PP) pellets, closed cell foams, microspheres, encapsulated phase changing materials (PCM). The beads can be hard shelled or flexible. In one embodiment, the beads are flexible and air can be evacuated from the beads. In one embodiment, hard beads can be mixed with flexible beads in which air can be evacuated from the flexible beads. In an alternative embodiment, fluidized material 15 can a porous foam substance including pockets of interstitial air. In one embodiment, fluidized material 15 can be a polyurethane foam. The polyurethane foam can be open or closed cell and cut into small shapes such as spheres or blocks. For example, a sphere of polyurethane foam can have a size of 2 inches in diameter. For example, a block of polyurethane foam can be a 1×1×1 inch block.

Suitable examples of fluidized material 15 can be formed of a mixture of microspheres and lubricant. The microspheres can include hollow or gas-filled structural bubbles (typically of glass or plastic) with an average diameter of less than 200 microns. The composition flows and stresses in response to a deforming pressure exerted on it and the composition ceases to flow and stresses when the deforming pressure is terminated. For example, fluidized material 15 can be formed of a product referenced to as Floam™. A flowable compound comprising lubricated microspheres, including the compound itself, formulations for making the compound, methods for making the compound, products made from the compound and methods for making products from the compound as defined by U.S. Pat. Nos. 5,421,874, 5,549,743, 5,626,657, 6,020,055, 6,197,099, and 8,171,585, each of which is hereby incorporated by reference into this application. Bladder 13 provides micro-contouring because fluidized material 15 can respond three-dimensionally.

For example, bladder 13 can be formed of a flexible plastic, such as urethane. Upon removal of residual air from fluidized material 15 bladder 13 flows concurrent with the flow of fluidized material 15 such that bladder 13 moves with movement of fluidized material 15. Bladder 13 can have a size and shape to support lower leg 16 and heel 17 of a user. Bladder 13 can include portion 18 which extends over top portion 19 of lower leg 16. Optionally, air can communicate throughout the whole bladder 13 for allowing maximum contouring and functional displacement of both the air and the fluidized chamber thereby providing maximum contouring to a desired body part.

Inner positioner 14 or outer support 52 can include thermo-regulating medium. Thermo-regulating medium can be a phase change material for adjusting the temperature to adapt support system 10 to temperature changes of a body part of a user. Thermo-regulating material can be associated with fluidized material 15 or cover (not shown) placed over inner positioner 14. An example material for thermo-regulating material is manufactured by Outlast Technologies as fibers, fabrics, and foams comprising micro-encapsulated phase changing materials referred to as Thermocules, which store and release heat as further described in U.S. Pat. Nos. 7,790,283, 7,666,502 and 7,579,078, hereby incorporated by reference into this application.

For example, the pressure in ultra low pressure plenum 53 can be below 20 mm of water. It will be appreciated that all equivalents such as mm Hg and PSI can be used for measuring the pressure within ultra low pressure plenum 53.

The pressure within ultra low pressure plenum 53 can be below about 20 mm of water if no inner positioner is used or if an area of less than about 30% of outer support 52 is covered by inner positioner 14. The pressure within ultra low pressure plenum 54 can be below about 10 mm of water if an area of between about 30% to about 60% of outer support 52 is covered by inner positioner 14. The pressure within ultra low pressure plenum 53 can be below about 5 mm of water if an area of greater than about 60% of outer support 52 is covered by inner positioner 14.

Figure 4:
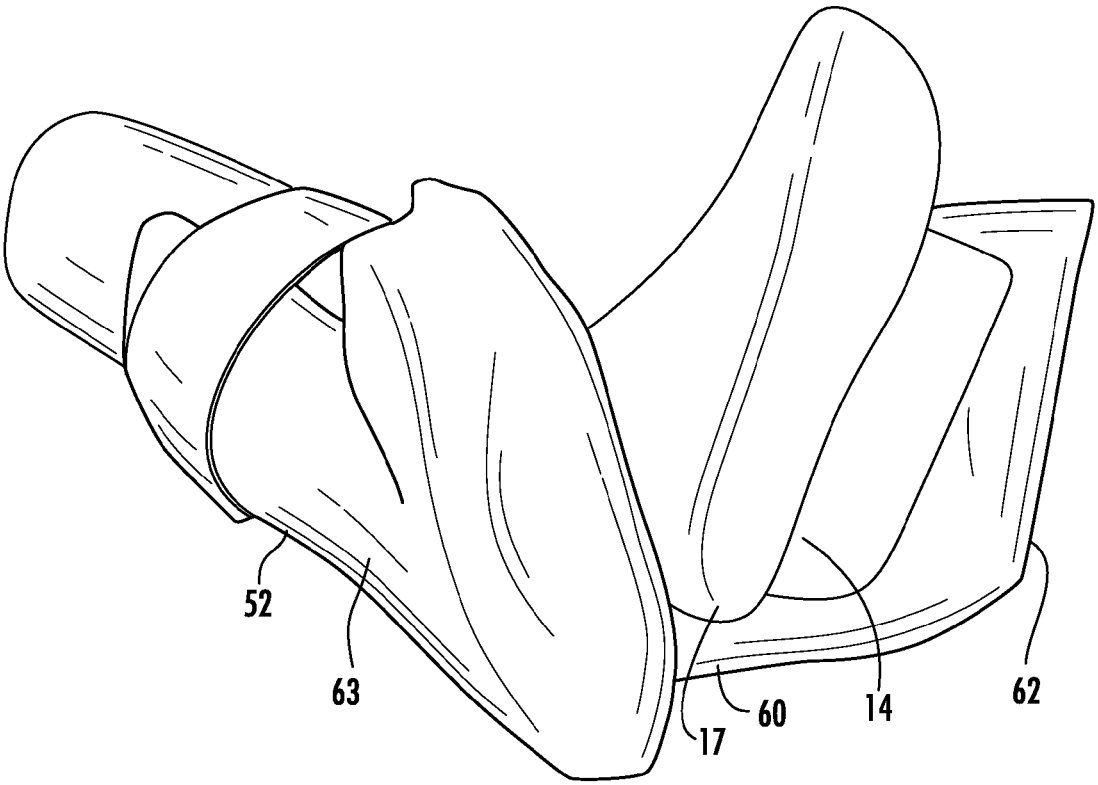
FIG. 4 is a schematic diagram of the embodiment of the compression device in combination with a fluidized lower leg protection and support system shown in FIG. 1A from a rear side in an open position.
Figure 5:
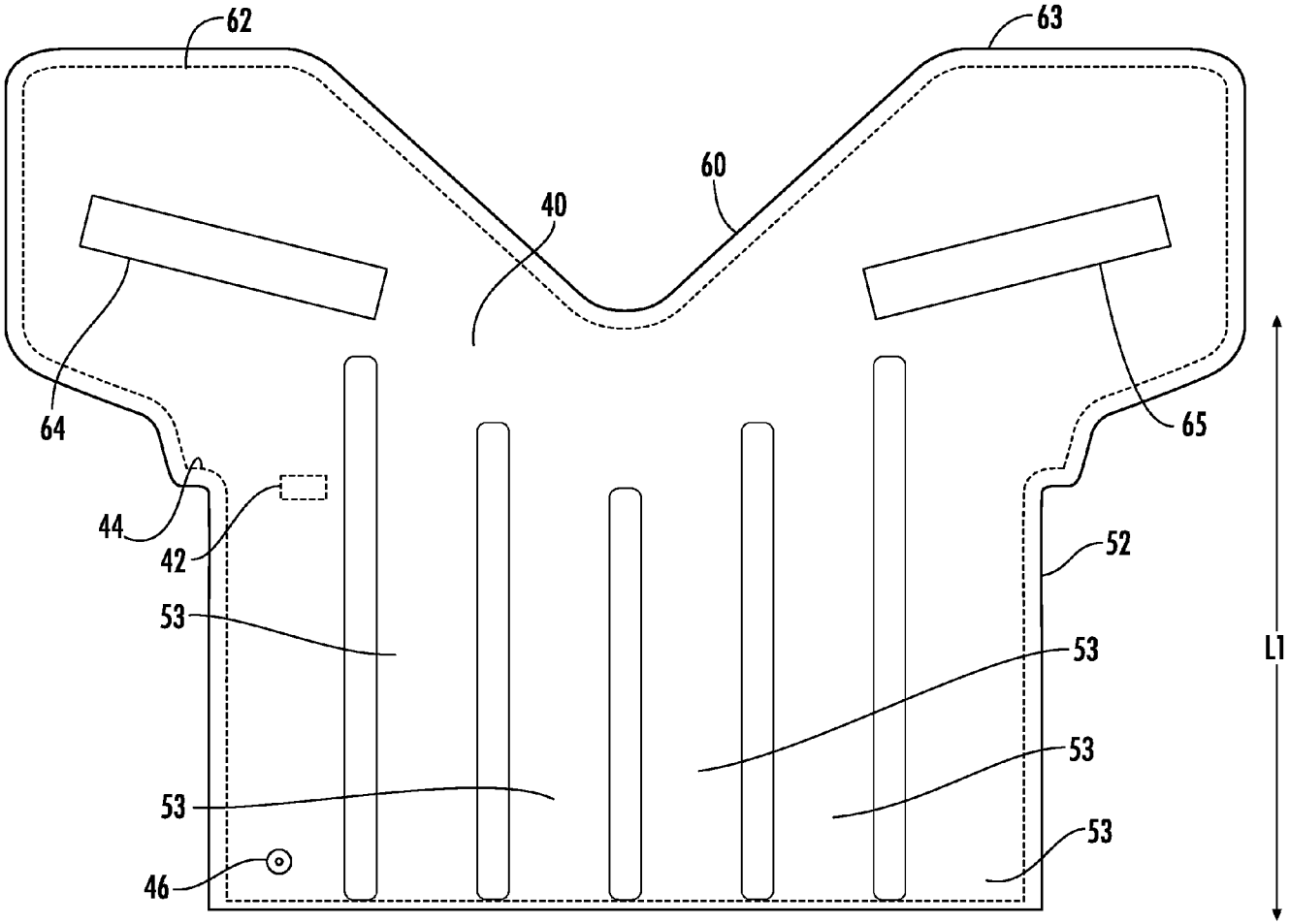
FIG. 5 is a schematic plan view of the embodiment of the compression device in combination with a fluidized lower leg protection and support system shown in FIG. 1A.

Rear end 60 of outer support 52 can include overlapping flap members 62 and 63 for forming a gate to allow access to foot 19 including heel 17, as shown in FIGS. 3A-3B. Flap members 62 and 63 can include respective coupling portions 64 and 65 for attaching flap members 62 and 63 to one another. For example, coupling portions 64 and 65 can be formed of a hook and loop material. Flap members 62 and 63 can be opened to allow access to foot 19, as shown in FIG. 4.

Figure 6:
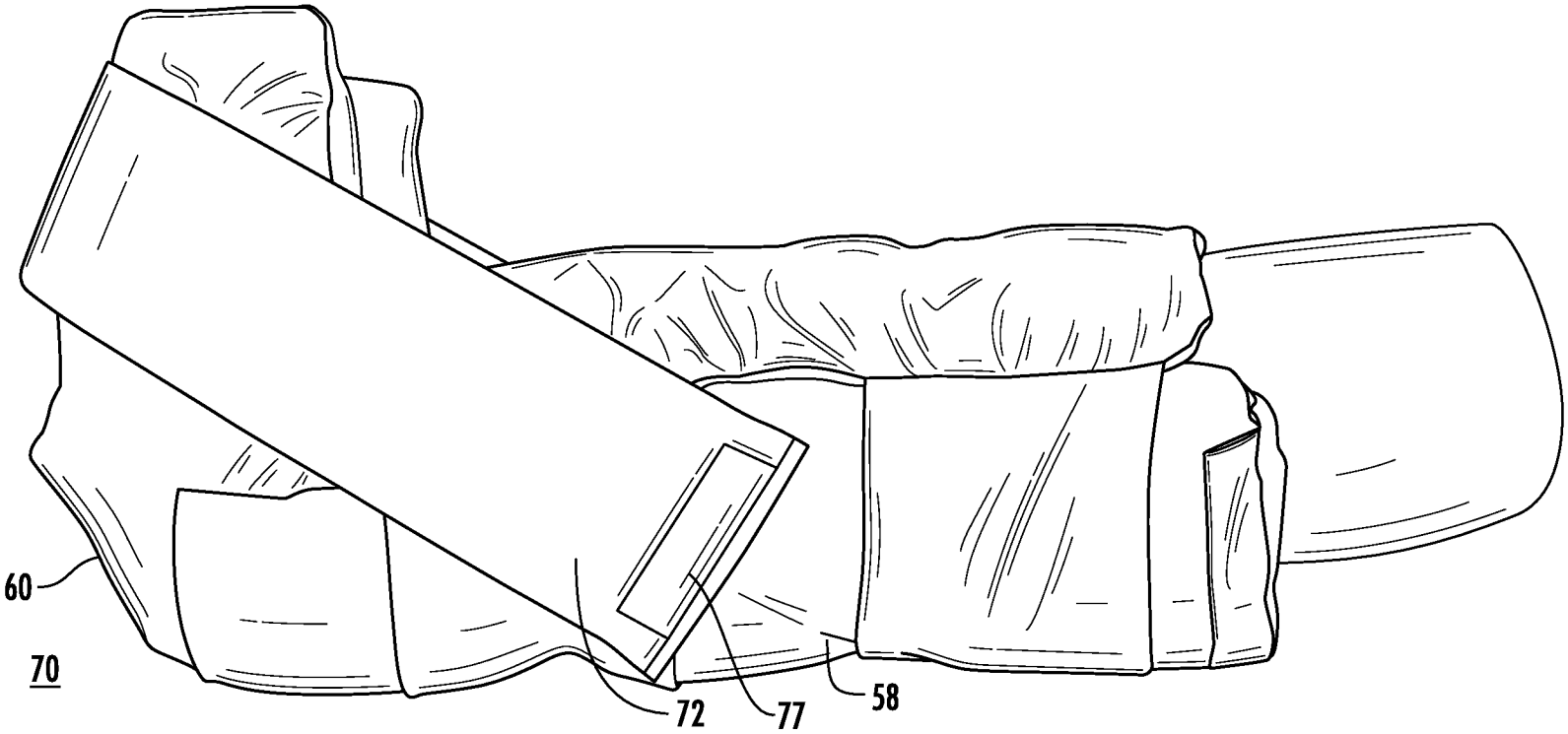
FIG. 6 is a schematic diagram of an alternate embodiment of the compression device in combination with a fluidized lower leg protection and support system including an outer support and support strap.

FIG. 6 illustrates an alternate embodiment of a fluidized lower leg protection support system 70, including support strap 72. Support strap 72 can extend around rear end 60 for providing support, for example, in supporting a patient with foot drop. Support strap 72 can include coupling portion 77 at one end thereof. Coupling portion 77 can be formed of a hook and loop material. Coupling portion 77 can attach to attachment section 58.

Figure 7:
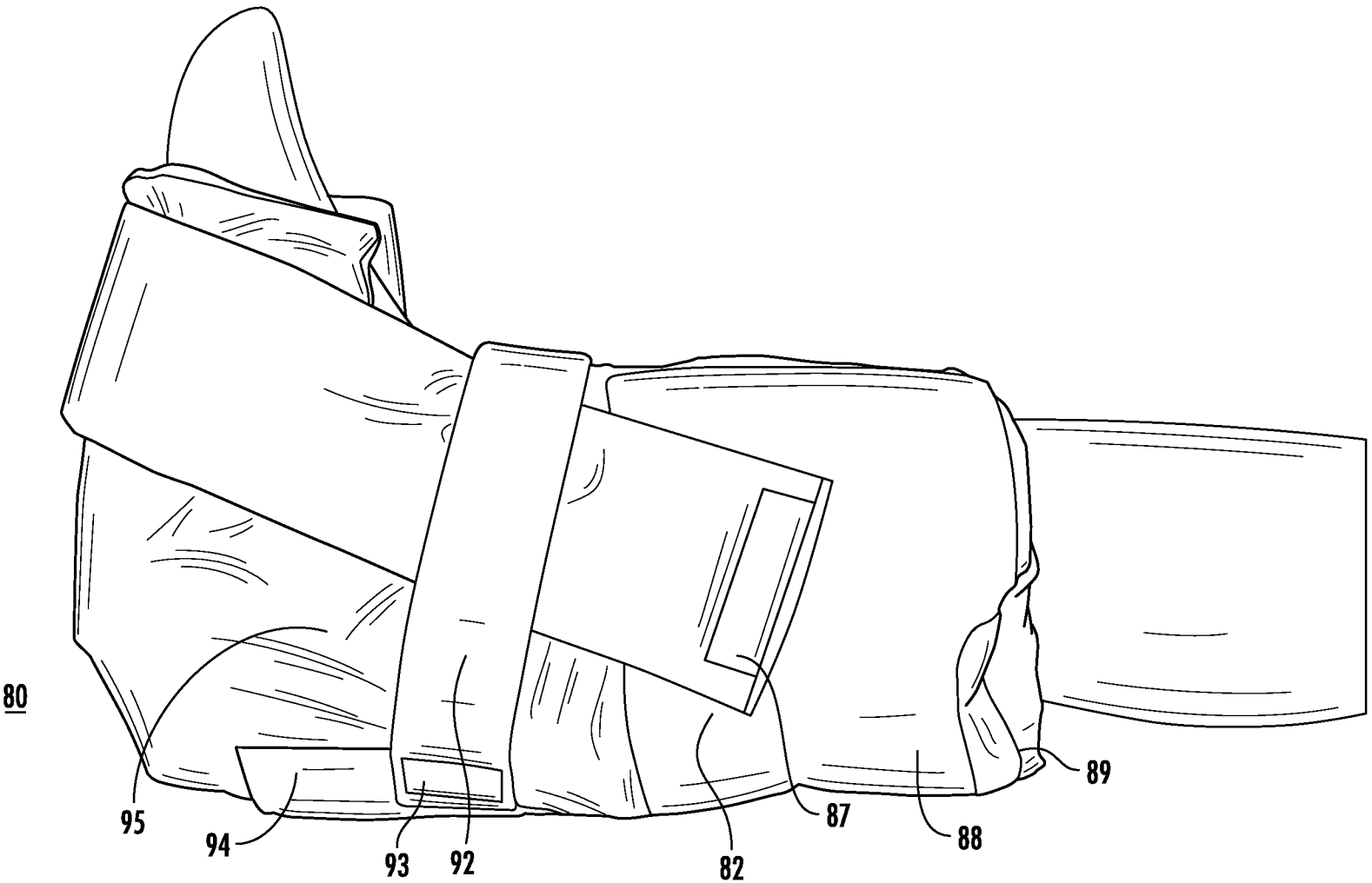
FIG. 7 is a schematic diagram of an alternate embodiment of the compression device in combination with a fluidized lower leg protection and support system including an outer support, support strap and ankle strap.
Figure 8:
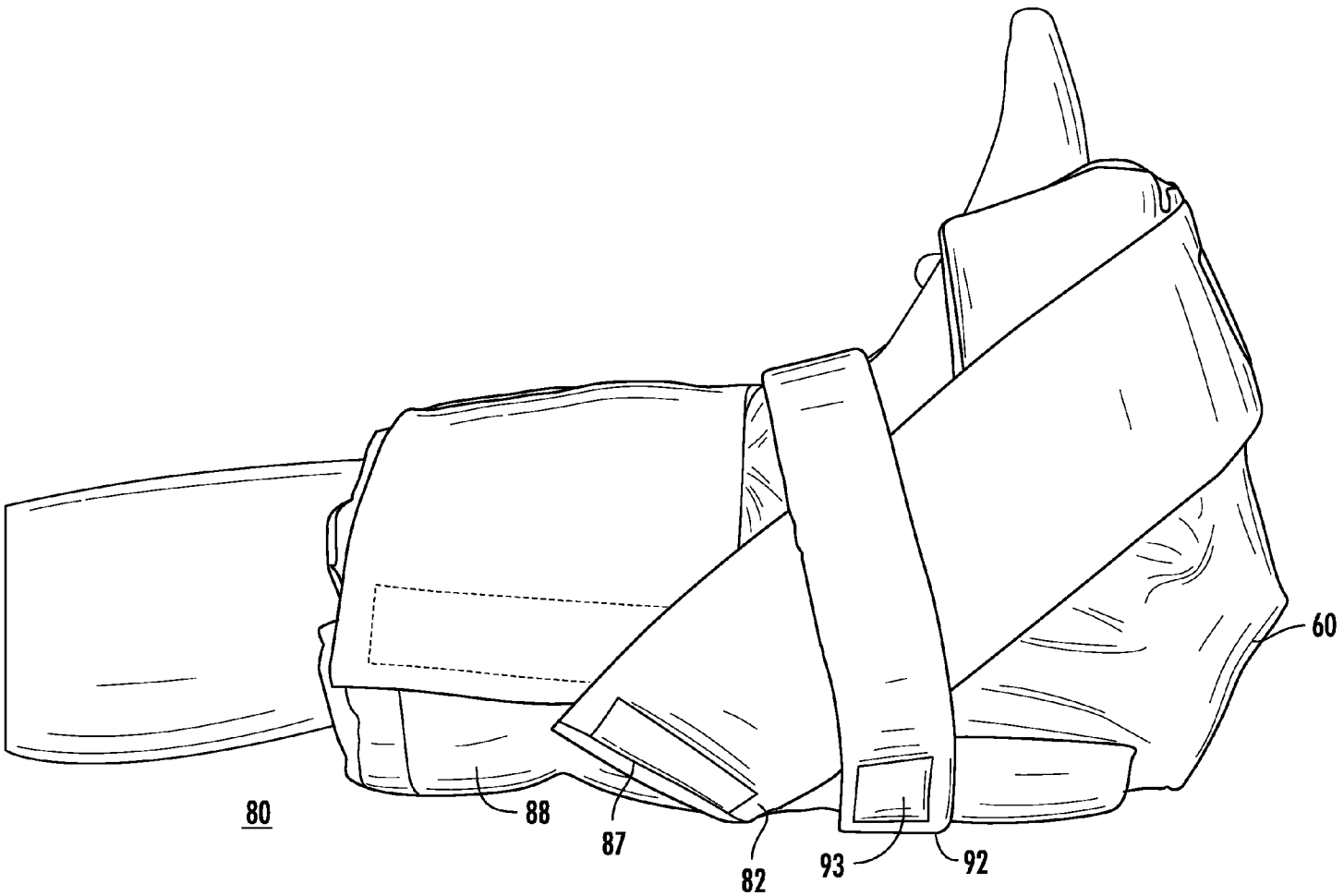
FIG. 8 is a schematic diagram of the embodiment of the compression device in combination with a fluidized lower leg protection and support system shown in FIG. 7 from an opposite side.

FIGS. 7 and 8 illustrate an alternate embodiment of a fluidized lower leg protection and support system 80. Support strap 82 can include coupling portion 87 at one end thereof. Coupling portion 87 can be formed of a hook and loop material. Coupling portion 87 can attach to attachment section 88. Attachment section 88 can be positioned circumferentially around top portion 89. Coupling portion 87 can be coupled at various locations on attachment section 88. Ankle strap 92 can attach to attachment section 94. Ankle strap 92 can include coupling portion 93 at one end thereof. Coupling portion 93 can be formed of a hook and loop material. Attachment section 94 can be formed of a hook and loop material. Ankle strap 92 can be positioned above ankle 95. Attachment section 94 can be positioned adjacent or below ankle 95.

Figure 9:
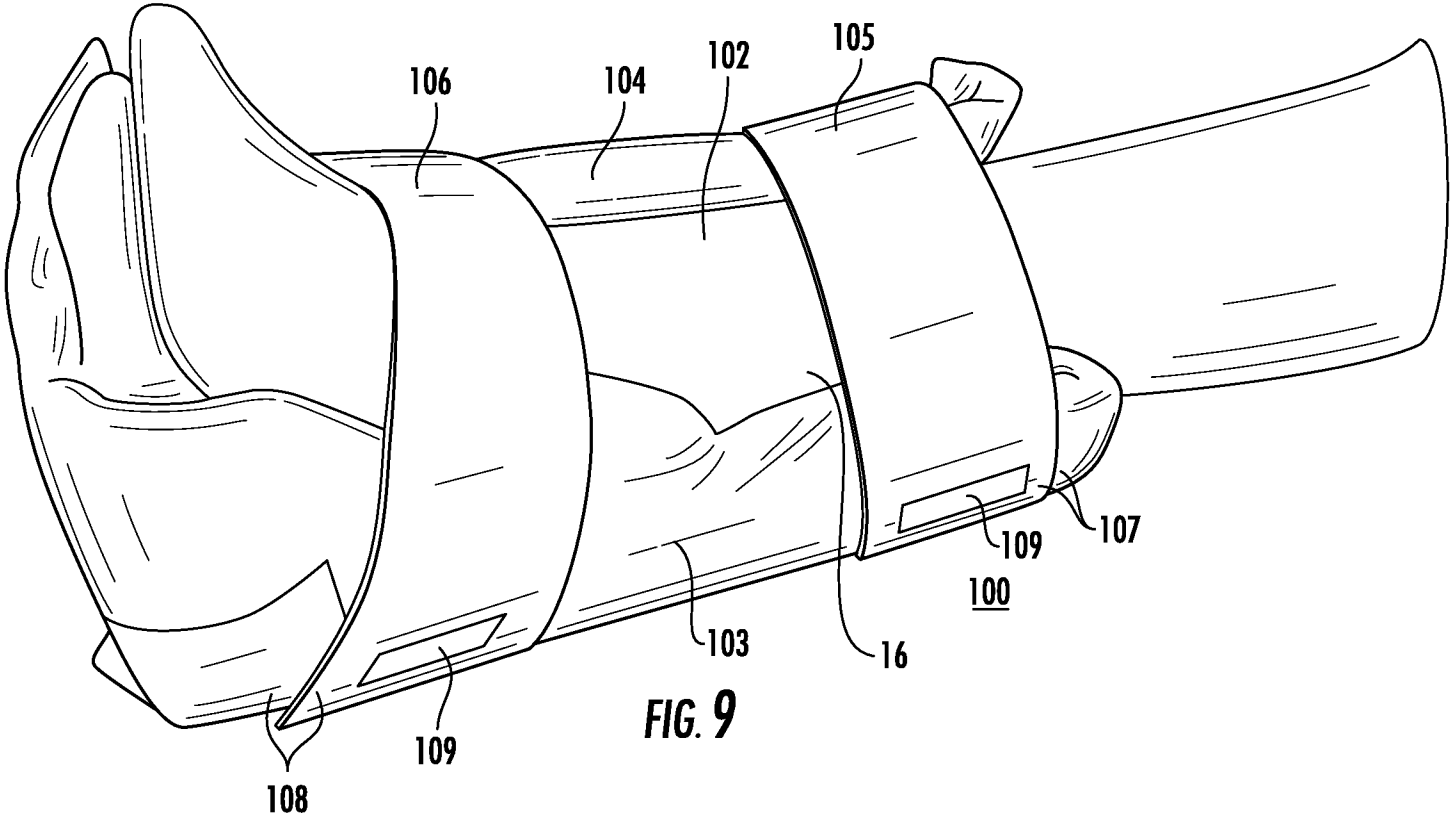
FIG. 9 is a schematic diagram of an alternate embodiment of the compression device in combination with a fluidized lower leg protection and support system including an opening between side portions of the outer support.

FIG. 9 illustrates an alternate embodiment of a fluidized lower leg protection and support system 100 which includes opening 102 between side portions 103 and 104 for allowing air to contact lower leg 16 and allowing cooling of lower leg 16 while providing support. Straps 105 and 106 can attach to respective attachment sections 107 and 108. Straps 105 and 106 can include coupling portion 109 at one end thereof. Coupling portion 109 can be formed of a hook and loop material. Attachment section 107 and 108 can be formed of a hook and loop material.

Inner positioner 14 described above can be used with each of the fluidized lower leg protection and support systems 50, 70, 80 and 100. In one embodiment, inner positioner 14 is positioned horizontally at ankle 19 and wraps around the Achilles to protect the ankle.

FIGS. 10-15 illustrate leg protection and support system having compression 200. Outer support 202 includes one or more of parallel rows of ultra low pressure plenums 203 forming outer support bladder 201. For example, ultra low pressure plenums 203 can be positioned within outer support 202 along the length $L_1$ of outer support 202. Flap 204 can include ultra low pressure air plenums 205.

Figure 10A:
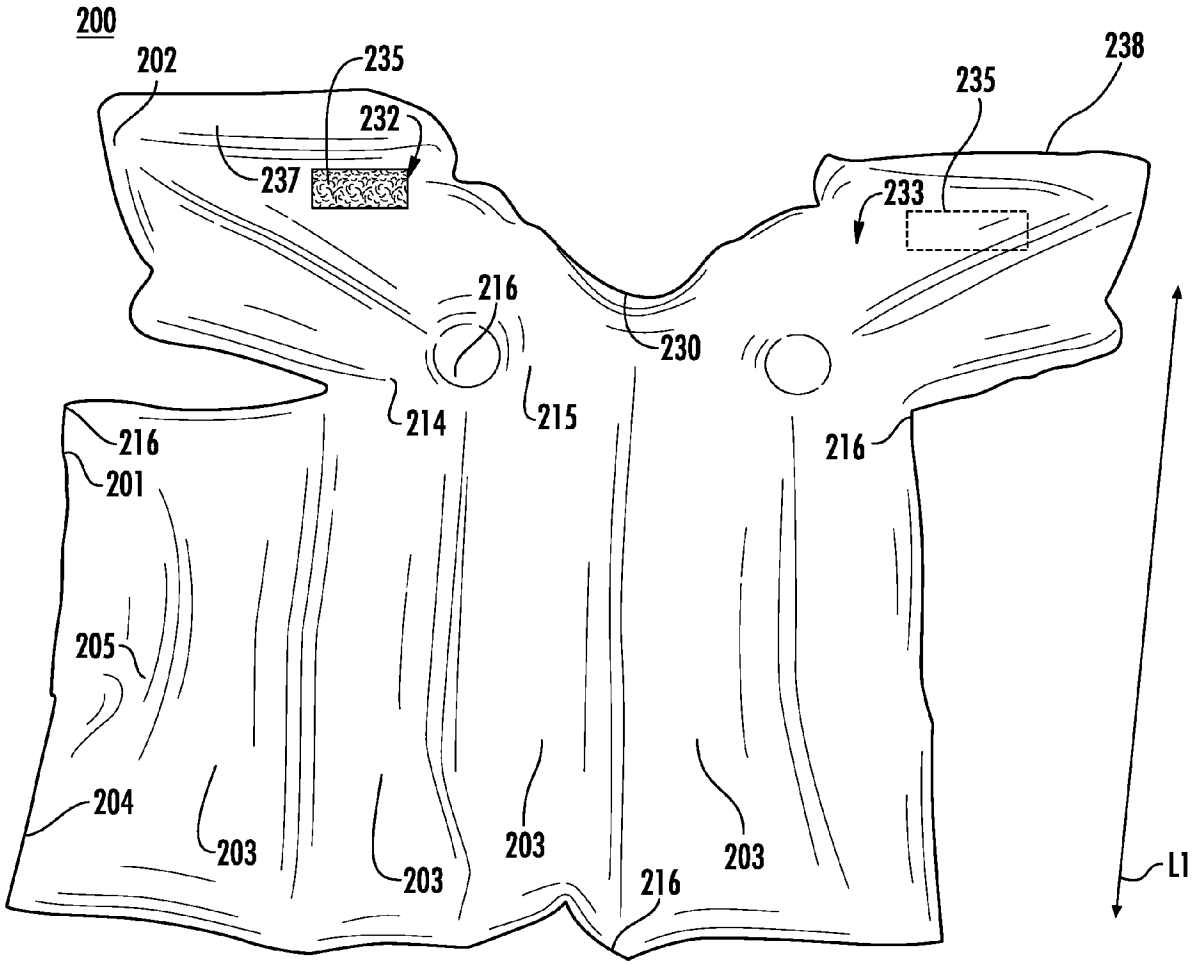
FIG. 10A is a top perspective view of an alternate embodiment of the compression device in combination with a fluidized lower leg protection and support system in a fully open position.

Compression bladder 214 can be positioned on inner surface 215 of outer support 202, as shown in FIG. 10A. Compression bladder 214 can be integral with outer support 202 in which compression bladder is joined at edges 216 of outer support bladder 201. Support bladder 214 can extend into flap 204.

Figure 10B:
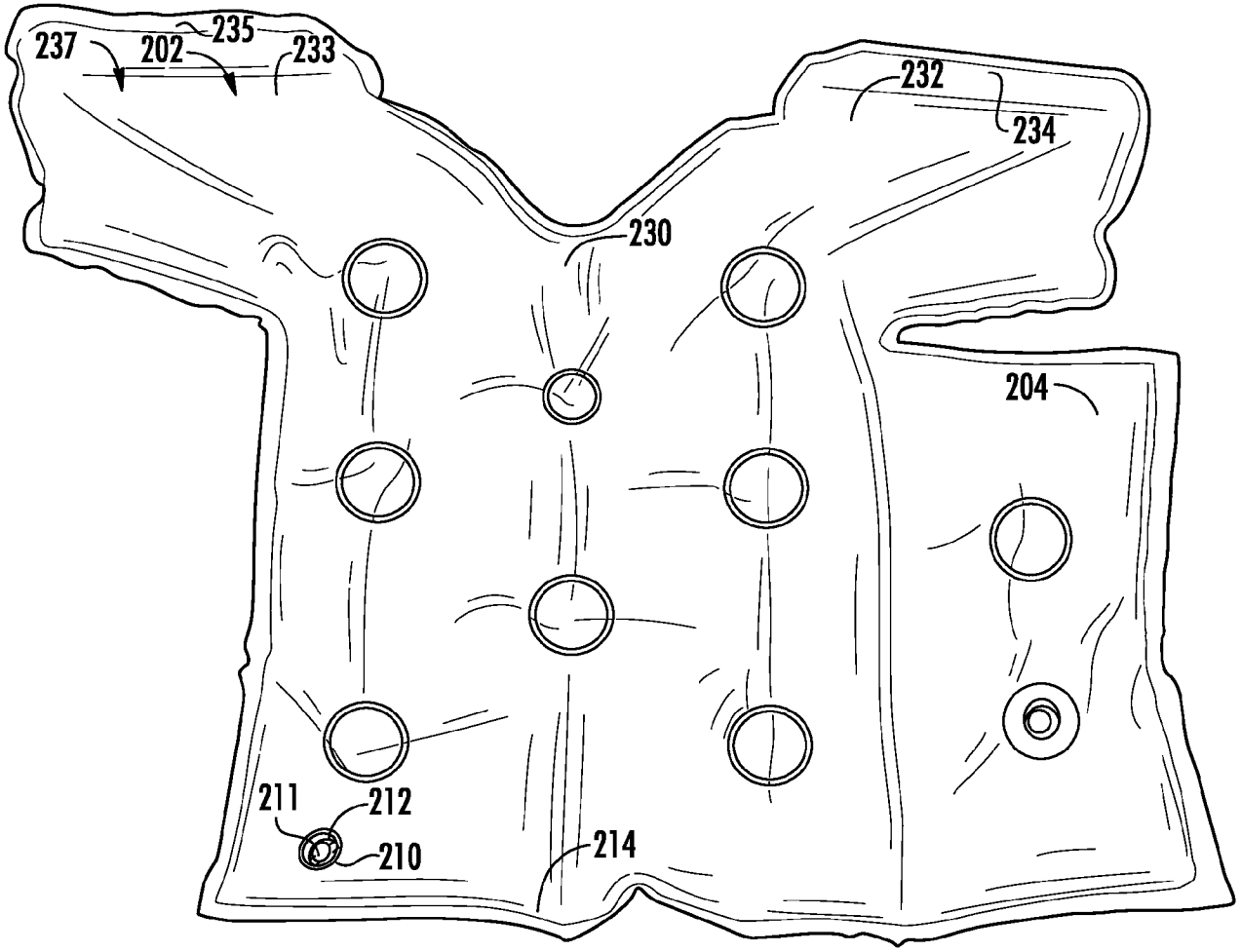
FIG. 10B is a bottom perspective view of the embodiment shown in FIG. 10A.
Figure 11:
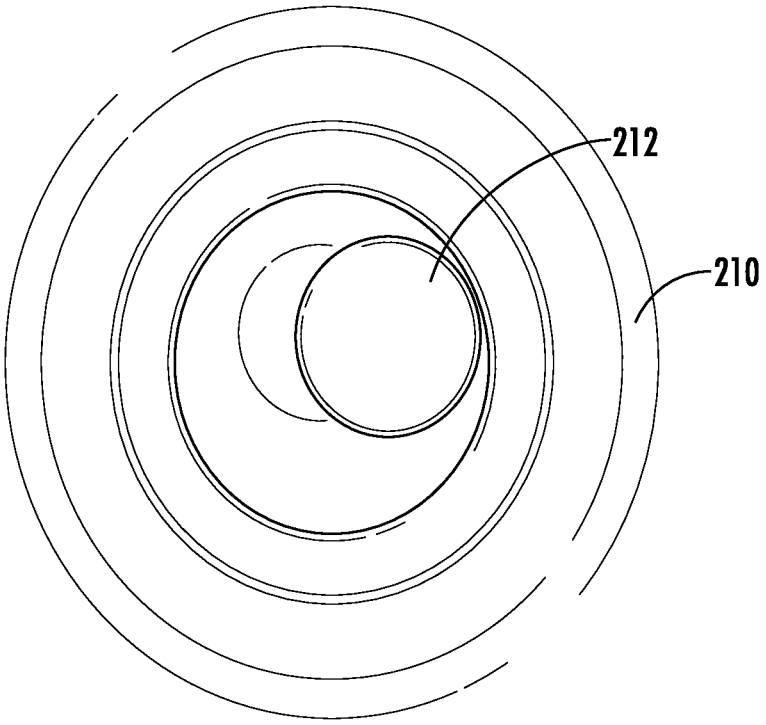
FIG. 11 is a top perspective view of the embodiment of FIG. 10A including an inner positioner.

Valve 210 extends through outer support 202 to provide access to end 211 of valve 210, as shown in FIG. 10B and FIG. 11. End 212 of valve 210 extends into compression bladder 214. Valve 220 extends through flap 204 of outer support 202 to provide access to end 221 of valve 220. End 222 of valve 220 extends into flap 204.

Figure 12:
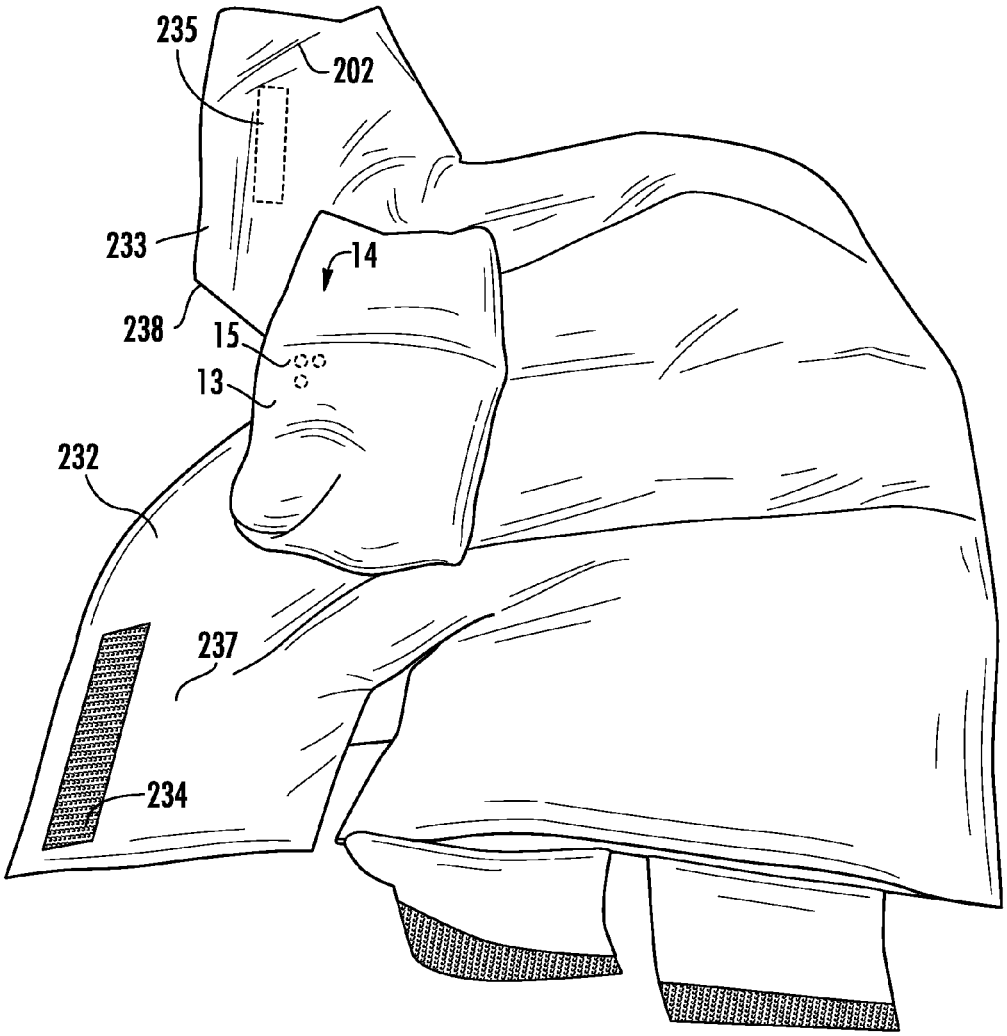
FIG. 12 is a top perspective view of the embodiment of FIG. 11 in which the rear end of the compression device in combination with a fluidized lower leg protection and support system is closed.

Rear end 230 of outer support 202 can include flap members 232 and 233, as shown in FIGS. 10A-10B. Flap members 232 and 233 can include respective coupling portions 234 and 235 for attaching flap members 232 and 233 to one another. In one embodiment, coupling portion 234 is attached to inner surface 237 of flap member 232 and coupling portion 235 is attached to outer surface 238 of flap member 233, as shown in FIG. 12. For example, coupling portions 234 and 235 can be formed of a hook and loop material.

Figure 13:
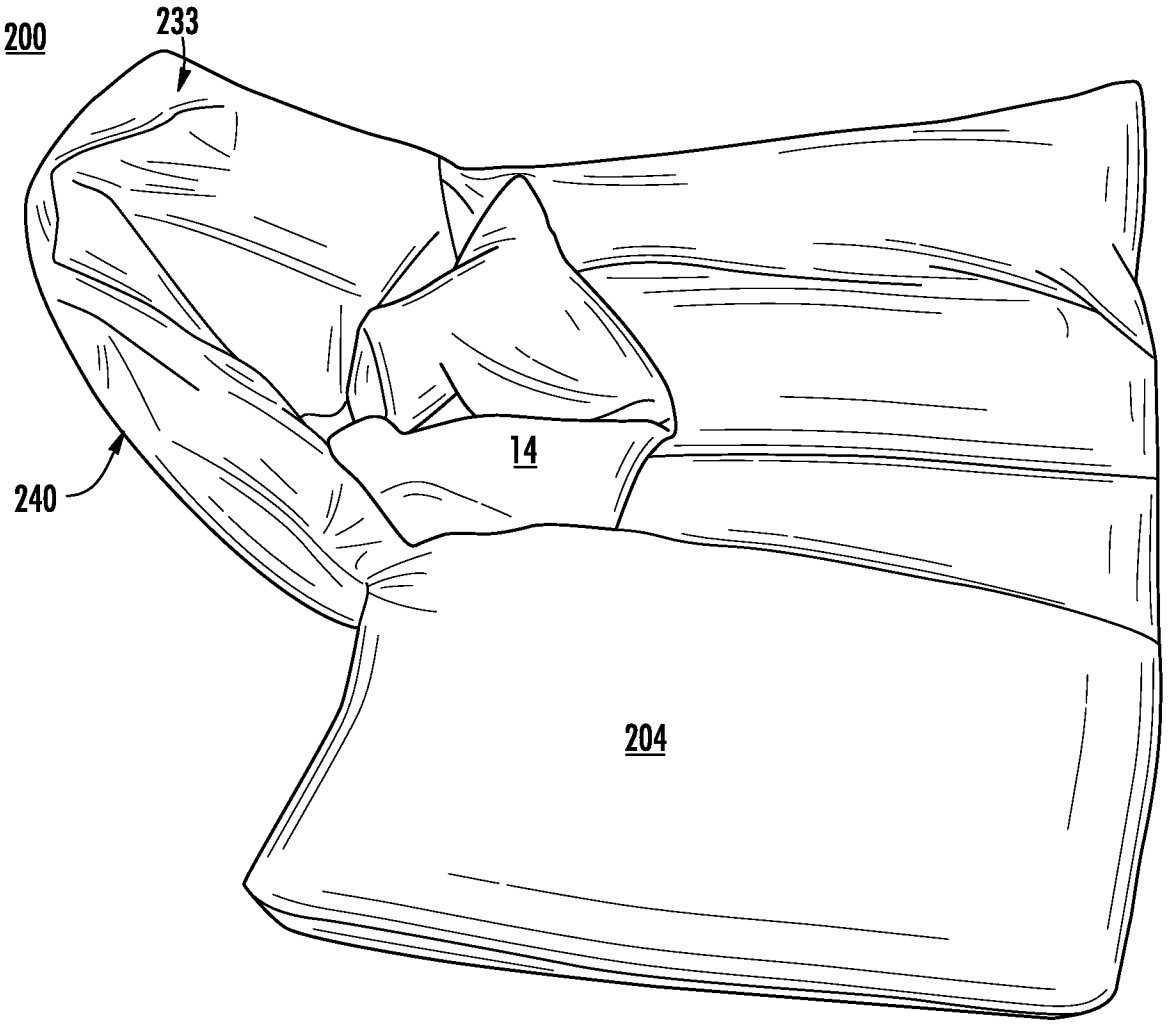
FIG. 13 is a top perspective view of the embodiment of FIG. 12 in which a lower leg is placed adjacent the rear end of the compression device in combination with a fluidized lower leg protection and support system.
Figure 14:
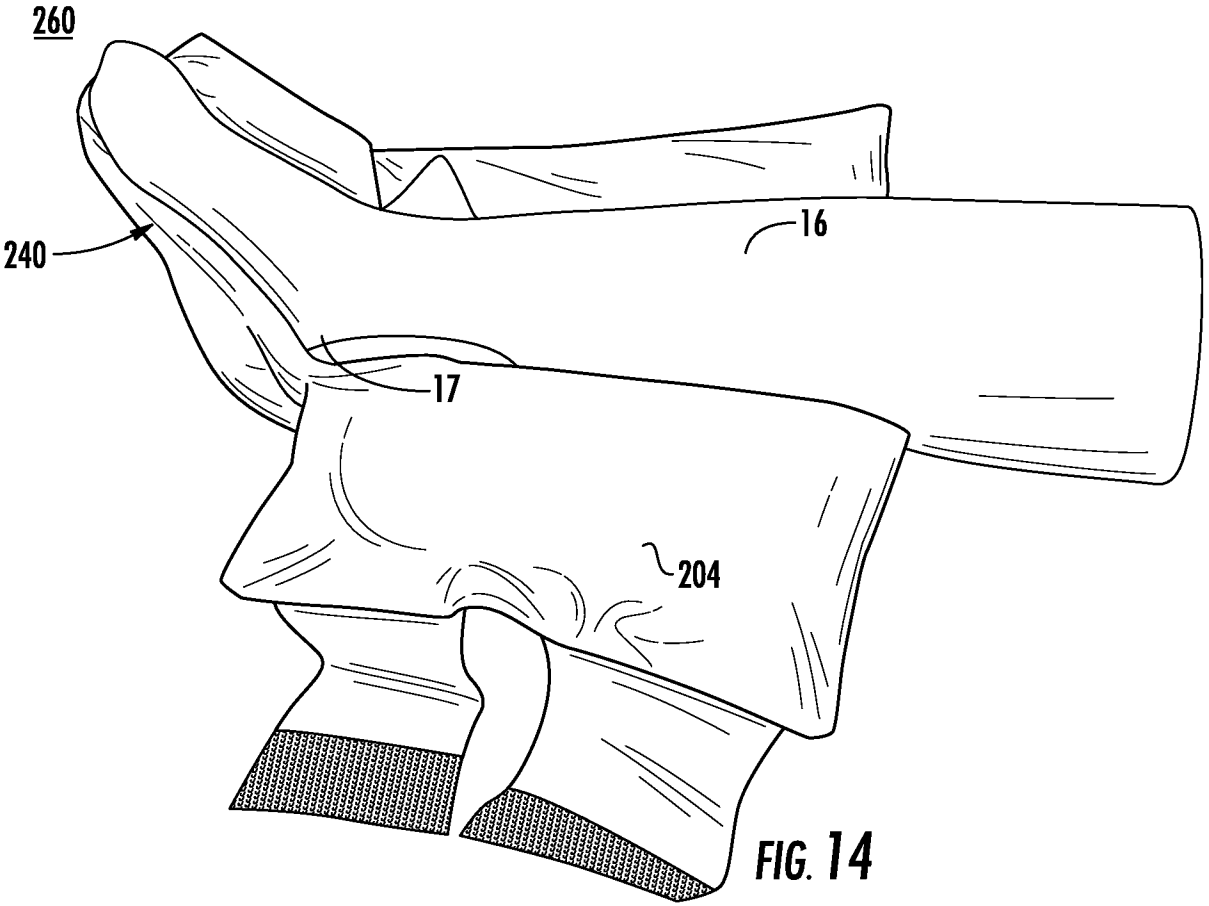
FIG. 14 is a top perspective view of the embodiment of FIG. 13 in which a flap of the compression device in combination with a fluidized lower leg protection and support system is closed over the received lower leg.
Figure 15:
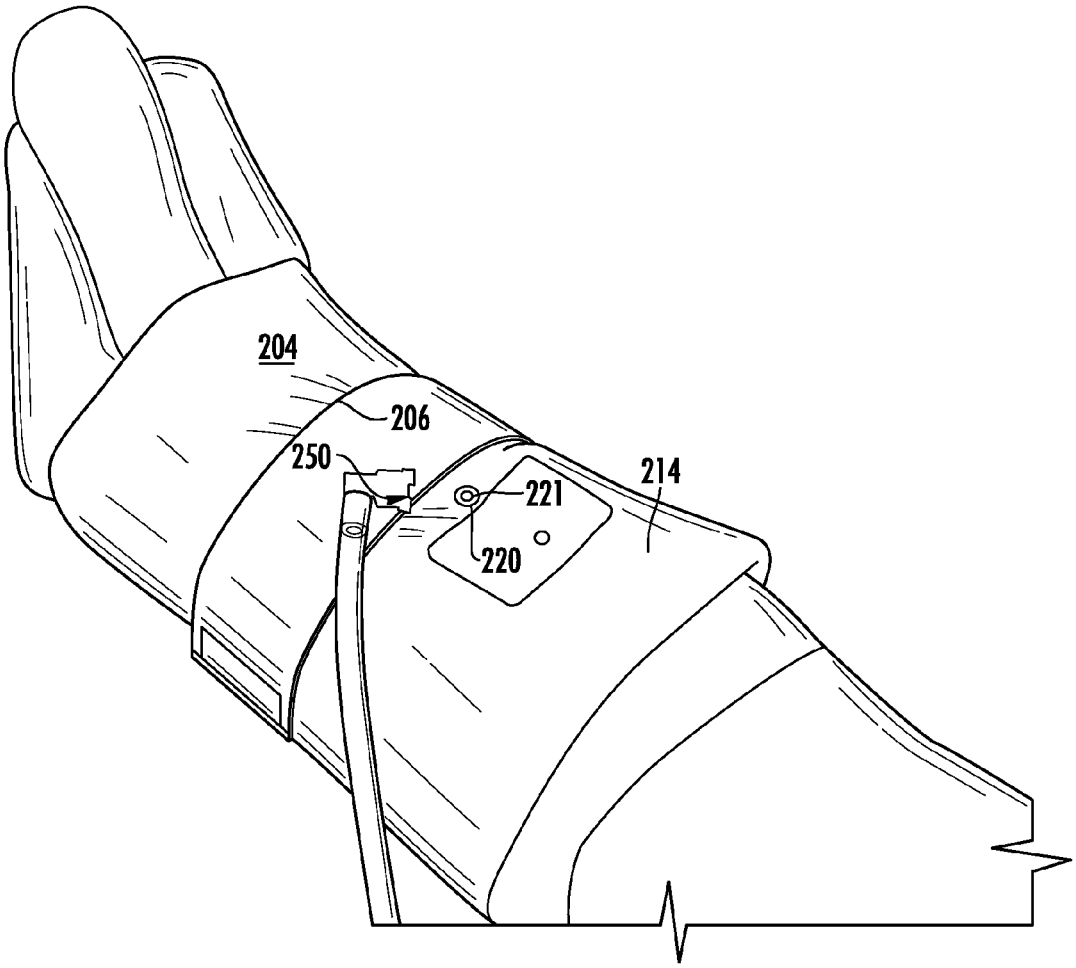
FIG. 15 is a top plan view of a valve extending through the compression device in combination with a fluidized lower leg protection and support system for attachment to the compression device.

During use, inner positioner 14 can be placed over outer support 202, as shown in FIG. 12. Flap members 232 and 233 are attached to one another for closing leg protection and support system having compression 200 and forming foot and heel support portion 240 of outer support 202, as shown in FIG. 13. Lower leg 16 is received in leg protection and support system having compression 200 adjacent to heel support 240, as shown in FIG. 14. Inner positioner 14 provides three dimensional contouring to the received lower leg 16 and heel 17. Flap 204 can be closed over lower leg 16, as shown in FIG. 15. Strap 206 can be adjusted for closing flap 204. End 221 of valve 220 can be connected to compression device 250. Compression device 250 can provide pneumatic pressure for inflating and deflating compression bladder 214 in a sequential or intermittent manner.

Figure 16:
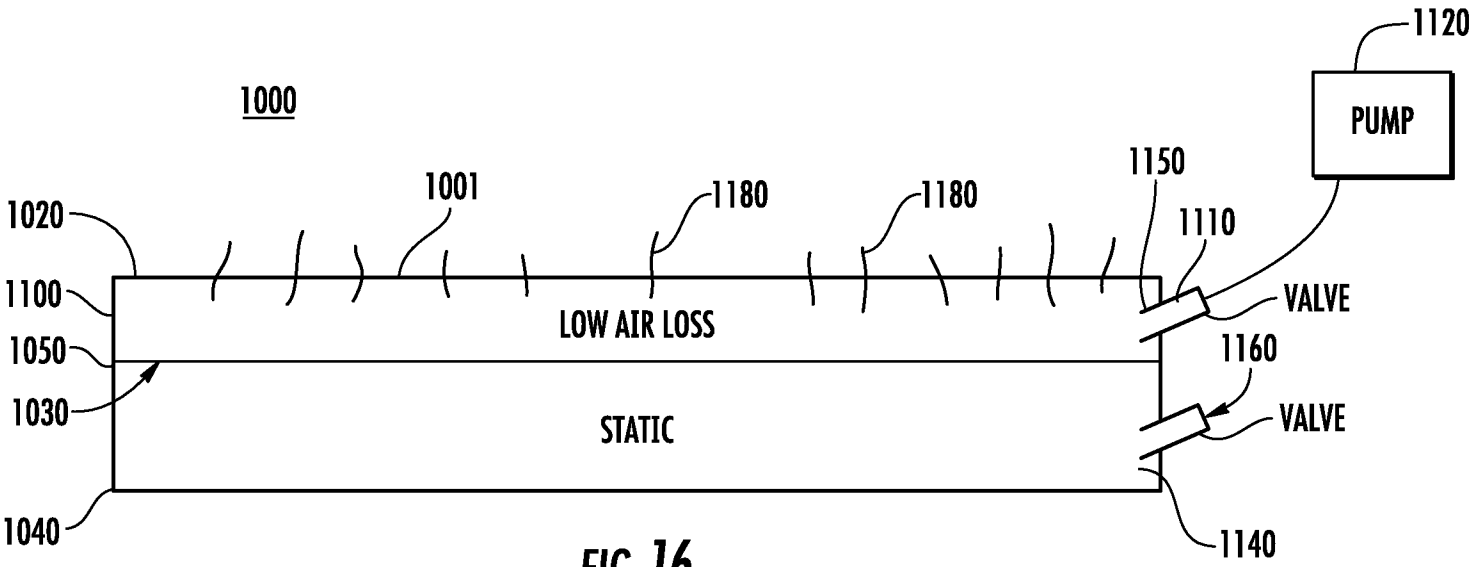
FIG. 16 is a schematic diagram of the compression device including a plenum providing low air loss.

FIG. 16 illustrates an alternate embodiment of compression device in combination with lower leg support system 1000. Outer support 1001 of system 1000 has a three layer construction. Top layer 1020, intermediate layer 1030 and bottom layer 1040 are sealed to one another along outside edge 1050. For example, top layer 1020, intermediate layer 1030 and bottom layer 1040 can be formed of urethane.

Plenum 1100 formed between top layer 1020 and intermediate layer 1030 can include dynamic air. Air 1150 is pumped into plenum 1100 through valve 1110 by pump 1120. Air 1150 is pumped beneath top layer 1020. Top layer 1020 is perforated with apertures 1180. Plenum 1100 provides a dynamic amount of air to system 1000 for adjusting the amount of air in plenum 1140 and providing low air loss.

Plenum 1140 formed between bottom layer 1040 and intermediate layer 1030 can include a fixed amount of static air. In one embodiment, plenum 1140 is filled with an ultra low pressure of a pressure of about 500 millibars through about 10 millibars or in some cases even lower pressures can be used. Valve 1160 can be used to adjust the pressure in plenum 1140.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A support system for a body part comprising:

an outer support comprising an ultra low pressure plenum including a gas therein, a pressure in said ultra low pressure plenum is in a range of about 20 mm of water to about 5 mm of water, a compression bladder positioned on an inner surface of said outer support, an inner positioner, said inner positioner comprises a bladder filled with a fluidized particulate material, said inner positioner being received on said compression bladder, wherein said compression bladder is adapted to be inflated in a sequential or intermittent manner and said inner positioner displaces said gas within said ultra low pressure plenum.

2. The support system of claim 1 wherein said compression bladder is integral with said outer support and said compression bladder is attached to edges of said outer support.

3. The support system of claim 1 further comprising:

a valve having a first end extending from the outer support and a second end extending into said compression bladder.

4. The support system of claim 3 further comprising:

a compression device removably attached to said compression bladder, said compression device inflating said compression bladder.

5. The support system of claim 1 wherein the compression bladder is adapted to receive a foot and the inflation of said compression bladder displaces gas from said outer support to the foot for providing massaging of the foot.

6. The support system of claim 1 wherein said fluidized material is selected from the group comprising beads, polyethylene beads, polystyrene (PS) beads, expanded polyethylene (PE), crosslinked expanded polyethylene (PE), polypropylene (PP) pellets, closed cell foams, microspheres, and encapsulated phase changing materials (PCM).

7. The support system of claim 1 wherein said pressure within said bladder of said inner positioner has a pressure in the range of about 500 millibars to about 5 millibars.

8. The support system of claim 1 wherein said pressure within said bladder of said inner positioner has a pressure in the range of about 350 millibars to about 5 millibars.

9. The support system of claim 1 wherein said outer support comprises a plurality of ultra low pressure plenums.

10. The support system of claim 1 wherein said outer support has an opening in a front portion and further comprises a flap for closing the opening.

11. The support system of claim 1 wherein a rear end of said outer support includes overlapping outer support flap members, each of said outer support flap members including a coupling portion, said coupling portions attaching said outer support flap members to one another, wherein said outer support flap members are adapted to be opened to provide access to a foot received on the support system.

12. The support system of claim 11 wherein the coupling portions are formed of a hook and loop material.

13. The support system of claim 11, said outer support further comprising a support strap, said support strap extending from said outer support flap members around the rear end of said outer support.

14. The support system of claim 13 wherein said support strap includes a coupling portion at one end thereof, said coupling portion of said support strap being coupled to an attachment section of said outer support.

15. The support system of claim 14 wherein the coupling portion of said support strap is formed of a hook and loop material.

16. The support system of claim 11 further comprising an ankle strap, said ankle strap including a coupling portion at one end thereof, the coupling portion of the ankle strap being coupled to an attachment section of said outer support.

17. The support system of claim 16 wherein the coupling portion of said ankle strap is formed of a hook and loop material.

18. The support system of claim 1 wherein said outer support includes an opening between side portions, one or more straps being attached to attachment portions of said side portions, said straps extending over said opening, wherein said opening is adapted to allow air to contact a lower leg received in said outer support.

19. The support system for a body part of claim 1 wherein the ultra low pressure plenum comprises a top layer, intermediate layer and bottom layer sealed to one another along respective edges, a first plenum formed between the top layer and the intermediate layer, said first plenum includes perforations and further comprising a valve connected to the first plenum and a pump, the pump providing a dynamic amount of air through said valve to the first plenum; and a second plenum formed between the bottom layer and the intermediate layer, said second plenum including a fixed amount of static air.

20. A method of supporting a body part comprising the steps of:

providing a support system having compression for a body part, said support system comprising an inner positioner, said inner positioner adapted to provide three dimensional contouring of the received body part, said inner positioner comprises a bladder filled with a fluidized particulate material, an outer support comprising an ultra low pressure plenum including a gas therein, a pressure in said ultra low pressure plenum is in a range of about 20 mm of water to about 5 mm of water, said outer support has an opening in a front portion and a flap for closing the opening and a compression bladder positioned on an inner surface of said outer support;

placing said body part over said inner positioner;

closing said flap for closing said outer support over the received body part, and inflating said compression bladder support in a sequential or intermittent manner, wherein said inner positioner displaces said gas within said ultra low pressure plenum.

21. The method of claim 20 wherein said outer support includes a pair of outer support flap members, each of said outer support flap members including a coupling portion, said coupling portion attaching said outer support flap members to one another and further comprising the step of opening said outer support flap members to provide access to a foot received on the support system.

22. The method of claim 20 wherein said fluidized material is selected from the group comprising beads, polyethylene beads, polystyrene (PS) beads, expanded polyethylene (PE), crosslinked expanded polyethylene (PE), polypropylene (PP) pellets, closed cell foams, microspheres, encapsulated phase changing materials (PCM).

23. The method of claim 20 wherein said pressure within said bladder of said inner positioner has a pressure in a range of about 500 millibars to about 5 millibars.

24. The method of claim 20 wherein the ultra low pressure plenum comprises a top layer, intermediate layer and bottom layer sealed to one another along respective edges, a first plenum formed between the top layer and the intermediate layer, said first plenum includes perforations and further comprising a valve connected to the first plenum and a pump, the pump providing a dynamic amount of air through said valve to the first plenum; and a second plenum formed between the bottom layer and the intermediate layer, said second plenum including a fixed amount of static air.

* * * * *